US011965353B2

(12) United States Patent
Ullrich et al.

(10) Patent No.: US 11,965,353 B2
(45) **Date of Patent: *Apr. 23, 2024**

(54) FENCE MESH AND MACHINE FOR THE FORMATION THEREOF

(71) Applicant: Ullrich Machinery Company Limited, Christchurch (NZ)

(72) Inventors: Mark William Ullrich, Christchurch (NZ); Owen Joris Meijer, Loburn (NZ); Michael Raymund Burtscher, Lake Tekapo (NZ)

(73) Assignee: UMC INNOVATION LIMITED (NZ)

( * ) Notice: Subject to any disclaimer, the term of this patent is extended or adjusted under 35 U.S.C. 154(b) by 265 days.

This patent is subject to a terminal disclaimer.

(21) Appl. No.: 17/109,425

(22) Filed: Dec. 2, 2020

(65) Prior Publication Data

US 2021/0164258 A1 Jun. 3, 2021

(30) Foreign Application Priority Data

Dec. 2, 2019 (NZ) ..... 759668

(51) Int. Cl.

| | |
|---|---|
| ***B21F 15/06*** | (2006.01) |
| ***B21F 27/02*** | (2006.01) |
| ***B21F 27/08*** | (2006.01) |
| ***E04H 17/04*** | (2006.01) |
| ***E04H 17/06*** | (2006.01) |

(52) U.S. Cl.

CPC ..... *E04H 17/06* (2013.01); *B21F 15/06* (2013.01); *B21F 27/02* (2013.01); *B21F 27/08* (2013.01); *E04H 17/04* (2013.01)

(58) Field of Classification Search

CPC ..... B21F 27/00; B21F 27/08; B21F 15/02; B21F 15/06; E04H 17/02

See application file for complete search history.

(56) References Cited

U.S. PATENT DOCUMENTS

| | | | | |
|---|---|---|---|---|
| 1,177,815 | A * | 4/1916 | Safford | B21F 27/08 140/11 |
| 1,873,461 | A * | 8/1932 | Nigro | B21F 33/04 5/257 |
| 6,668,869 | B2 * | 12/2003 | Richardson | B21F 15/06 140/11 |
| 6,715,512 | B2 * | 4/2004 | Richardson | B21F 27/08 140/101 |
| 7,788,441 | B2 * | 8/2010 | Lee | G06F 12/0246 711/103 |

(Continued)

FOREIGN PATENT DOCUMENTS

WO WO-2010126384 A1 * 11/2010 ..... E04H 17/04

*Primary Examiner* — Bobby Yeonjin Kim

(74) *Attorney, Agent, or Firm* — Galbreath Law Offices, P.C.; John A. Galbreath

(57) ABSTRACT

Fence mesh including line wires, and stay wires extending laterally across and intersecting the line wires to form a mesh, wherein a first type of wire knot is formed by a knot wire around the line wire and stay wire at intersections of the stay wires with the line wires in a primary zone, and wherein a second type of wire knot is formed by a knot wire around the line wire and stay wire at intersections of the stay wires with the line wires in a secondary zone, characterised in that the first type of wire knot is different from the second type of wire knot; and a machine for the formation of such a mesh.

5 Claims, 12 Drawing Sheets

(56) References Cited

U.S. PATENT DOCUMENTS

| | | | | |
|---|---|---|---|---|
| 2003/0178090 | A1* | 9/2003 | Richardson | B21F 15/06 140/11 |
| 2003/0221742 | A1* | 12/2003 | Richardson | B21F 27/08 140/11 |

* cited by examiner

FENCE MESH AND MACHINE FOR THE FORMATION THEREOF

CROSS REFERENCE TO RELATED APPLICATIONS

This application claims the benefit of New Zealand Patent Application Serial No. 759668, filed on Dec. 2, 2019. The entire disclosure of which is incorporated herein by reference.

TECHNICAL FIELD

The present invention relates to a new type of knotted wire fencing, and a machine for forming it.

BACKGROUND

Any discussion of the prior art throughout the specification is not an admission that such prior art is widely known or forms part of the common general knowledge in the field.

Knotted fence meshes are known, in which a number of parallel line wires extend generally horizontally between a series of supporting fence posts, forming a substantially rectangular lattice with a series of generally vertical stay wires, and at each intersection of a line wire with a stay wire, a third section of wire is twisted around the vertical and horizontal wires in a knot, to hold them together.

Knotted fences are used in applications such as stock fence, game fence, security and construction. An end user may choose from different types of fence mesh according to the particular characteristics most suitable for their application.

One type of known fence knot, shown in FIGS. 1*a* and 1*b* and hereinafter referred to as a "stay knot" 101, is also variously and interchangeably known as "X knot", "stiff stay", "stay lock", "horse fence", "stay lokk", "X fence", or "square deal knot".

One of the major advantages of a stay knot fence is that on a first side 102 there are no exposed wire ends, and also no tight coils. This has benefits in terms of animal welfare, because if an animal rubs against a stay knot fence, there are no sharp ends to penetrate its skin and cut the animal, and no coils to catch hair or fur. This is of additional benefit when the hides of the animals are of commercial value. It is often used for containing horses.

However, in some applications animals can distort the mesh of a stay knot fence by inserting a body part (e.g. leg, nose, horn, or antler) between two stay wires and twisting or pushing to force the stay knots to slide along the line wire, increasing the gap between the stay wires. For example, an animal may distort a fence near the bottom in order to reach its head through to graze on the other side of the fence. However, this distortion can sometimes allow smaller animals to escape the confinement of the fence altogether, or in larger animals can sometimes result in an animal becoming stuck between the fence wires.

Stay knot fences can be produced faster and more cheaply than fixed knot fences, because they use less knot wire, and the knots may be formed with fewer mechanical actions.

One machine for producing a stay knot fence is described in U.S. Pat. No. 6,668,869. The method described is sometimes known as "forging". A first linear movement bends the knot wire into a staple across the intersection of the line wire and stay wire, and a second linear movement from the other direction bends and wraps the ends of the knot wire to complete the knot.

Another type of known fence knot, shown in FIGS. 2*a* and 2*b* and hereinafter referred to as "fixed knot" 201, is also variously and interchangeably known as "fixed lock", "solid lock", "fixed lokk", "tight lock", "solid lock", or "stay tight".

In a fixed knot fence mesh the ends of the wire are exposed, and there are exposed tight coils on both sides of the fence. These can lead to damage to the hides of livestock that rub against a fixed knot fence. However, because the knot wire in a fixed knot fence twists around both the stay wire and the line wire at each intersection, it is much more difficult for an animal to push the knot along the stay wire. This makes a fixed knot fence much more resistant to distortion than a stay knot fence.

Each of these knotted fence meshes are typically made by specialised machines. A series of parallel line wires are fed into a bed of the machine, and a stay wire is fed into the machine across the line wires. A knot box, fed with a knot wire, is located adjacent the stay wire over each line wire. The knot boxes are each driven to bind the knot wire about an intersection between the stay wire and a line wire. Twister boxes on each side on the machine twist the ends of the stay wire about the outer-most line wires. The machine then feeds the line wires on, and repeats the process multiple times, to produce a rectangular mesh.

It is an object of the present invention to provide a new type of fence mesh, and/or a machine suitable for making at least one new type of fence mesh, and/or a machine which can make different types of fence mesh customised for different applications, and/or to provide the public with a useful choice.

DISCLOSURE OF INVENTION

Therefore the present invention provides a fence mesh including line wires, and stay wires extending laterally across and intersecting the line wires to form a mesh, wherein a first type of wire knot is formed by a knot wire around the line wire and stay wire at intersections of the stay wires with the line wires in a primary zone, and wherein a second type of wire knot is formed by a knot wire around the line wire and stay wire at intersections of the stay wires with the line wires in a secondary zone, wherein the first type of wire knot is different from the second type of wire knot.

Preferably one of the first type of wire knot and the second type of wire knot is a fixed knot. Preferably one of the first type of wire knot and the second type of wire knot is a stay knot.

Preferably, the fence mesh may include more than two zones.

In a first preferred embodiment, there are two zones, being a primary zone in which the wire knot is a fixed knot, and a secondary zone in which the wire knot is a stay knot.

In a second preferred embodiment, there are three zones, being a primary zone in which the wire knot is a fixed knot, a secondary zone in which the wire knot is a stay knot, and a tertiary zone in which the wire knot is a fixed knot.

In a third preferred embodiment, there are three zones, being a primary zone in which the wire knot is a stay knot, a secondary zone in which the wire knot is a fixed knot, and a tertiary zone in which the wire knot is a stay knot.

The present invention further provides a machine for making a fence mesh including line wires, and stay wires extending laterally across and intersecting the line wires to form a mesh, wherein a wire knot is formed by a knot wire around the line wire and stay wire at intersections of the stay wires with the line wires, the machine including a machine frame, at least one drive shaft, and a drive shaft driving means, wherein the machine also includes both at least one knot box configured to produce a first type of wire knot in a primary zone and at least one knot box configured to produce a second type of wire knot in a secondary zone, wherein the first type of wire knot is different from the second type of wire knot.

Preferably one of the first type of wire knot and the second type of wire knot is a fixed knot.

Preferably one of the first type of wire knot and the second type of wire knot is a stay knot.

Preferably, the machine may include more than two zones.

Preferably the machine includes at least four drive shafts. In a preferred embodiment, the machine includes five drive shafts. Preferably the drive shafts are rotary shafts. The drive shafts may optionally be driven either by a rotary gear box for converting a rotary input into the required timed Jo motion of the drive shafts, or by a series of servo motors coupled with an electrical controller.

In a preferred embodiment, the machine further includes a crimp drum and a stay wire projector.

In a further aspect, the present invention provides a stay knot box for the machine described above and having five rotary drive shafts, the knot box being configured to receive a line wire, a stay wire substantially perpendicular to the line wire, and a knot wire, and perform the actions of:

- receiving a first rotary motion and using it to feed the knot wire behind the line wire at an angle thereto;
- receiving a second rotary motion and using it to move a placer arm to position the stay wire adjacent the line wire at the intersection of the line wire and knot wire;
- receiving a third rotary motion that does not activate any mechanism in the stay knot box;
- receiving a fourth rotary motion that does not activate any mechanism in the stay knot box;
- receiving a fifth rotary motion and using it to twist a first end of the knot wire about the stay wire on a first side of the line wire, and to twist a second end of the knot wire about the stay wire on a second side of the line wire substantially opposite the first side.

In a further aspect, the present invention provides a fixed knot box for the machine described above and having five rotary drive shafts, the knot box being configured to receive a line wire, a stay wire substantially perpendicular to the line wire, and a knot wire, and perform the actions of:

- receiving a first rotary motion that does not activate any mechanism in the fixed knot box;
- receiving a second rotary motion and using it to move a placer arm to position the stay wire adjacent the line wire;
- receiving a third rotary motion and using it to feed the knot wire into a position adjacent the intersection between the line wire and the stay wire, parallel to the line wire, on an opposite side of the stay wire to the line wire;
- receiving a fourth rotary motion and using it to twist a first end of the knot wire on a first side of the stay wire under the line wire on a side of the line wire opposite the stay wire, and around the line wire in a 360° rotation, and also to twist a second end of the knot wire on a second side of the stay wire substantially opposite the first side under the line wire on a side of the line wire opposite the stay wire, and around the line wire in a 360° rotation;
- receiving a fifth rotary motion and using it to wind both the first end and the second end of the knot wire around the stay wire.

In a first preferred embodiment, the machine according to the present invention includes a primary zone including at least one fixed knot box as described above, and a secondary zone including at least one stay knot box as described above, wherein the same five drive shafts simultaneously provide rotary motion to all knot boxes.

In a second preferred embodiment, the machine according to the present invention includes a primary zone including at least one fixed knot box as described above, a secondary zone including at least one stay knot box as described above, and a tertiary zone including at least one fixed knot box as described above, wherein the same five drive shafts simultaneously provide rotary motion to all knot boxes.

In a third preferred embodiment, the machine according to the present invention includes a primary zone including at least one stay knot box as described above, and a secondary zone including at least one fixed knot box as described above, and a tertiary zone including at least one stay knot box as described above, wherein the same five drive shafts simultaneously provide rotary motion to all knot boxes.

BRIEF DESCRIPTION OF THE DRAWINGS

By way of non-limiting example only, preferred embodiments of the invention are described in detail below with reference to the accompanying drawings, in which.

BEST METHODS OF PERFORMING THE INVENTION

Figure 1A:
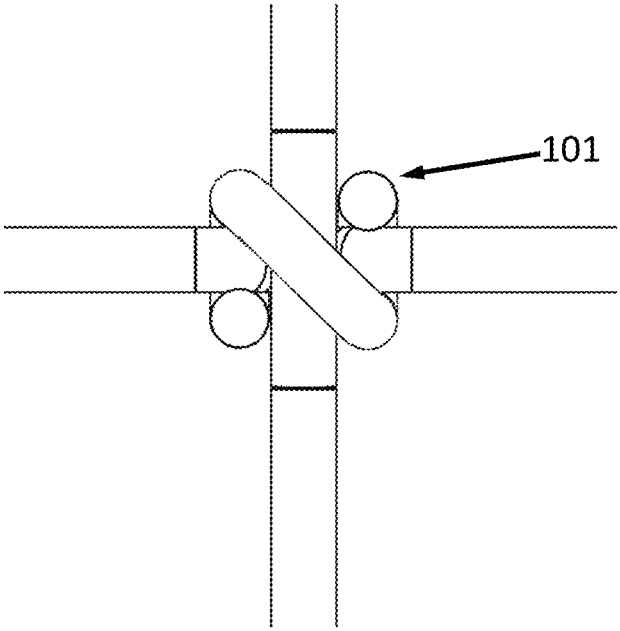
FIG. 1*a* is a back view of a stay knot in a fence mesh.
Figure 1B:
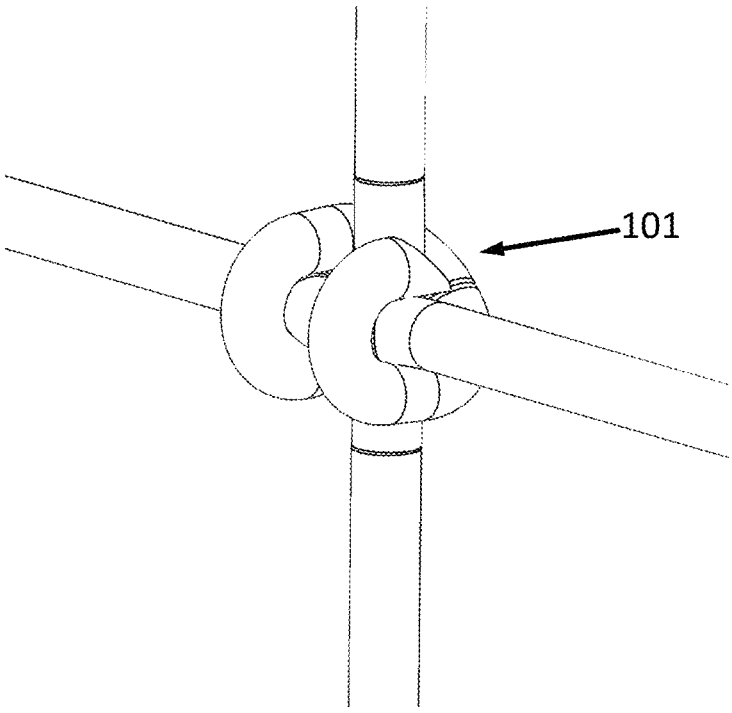
FIG. 1*b* is a front perspective view of a stay knot in a fence mesh.
Figure 2A:
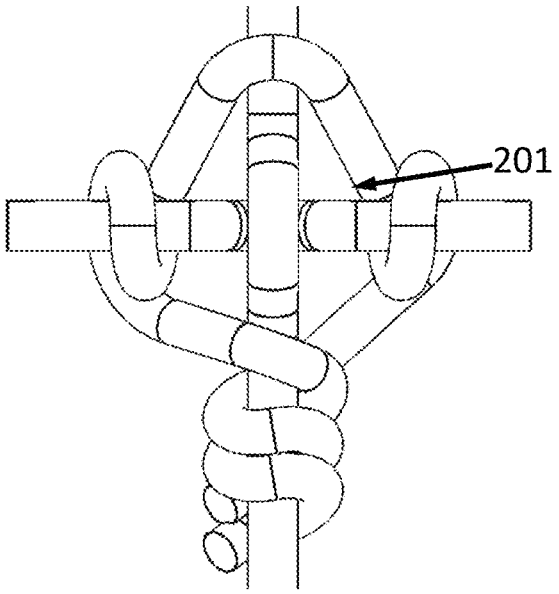
FIG. 2*a* is a back view of a fixed knot in a fence mesh.
Figure 2B:
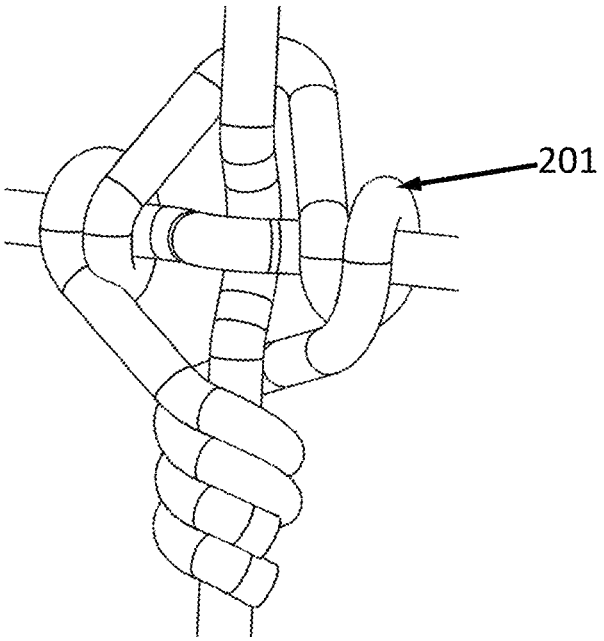
FIG. 2*b* is a front perspective view of a fixed knot in a fence mesh.
Figure 3:
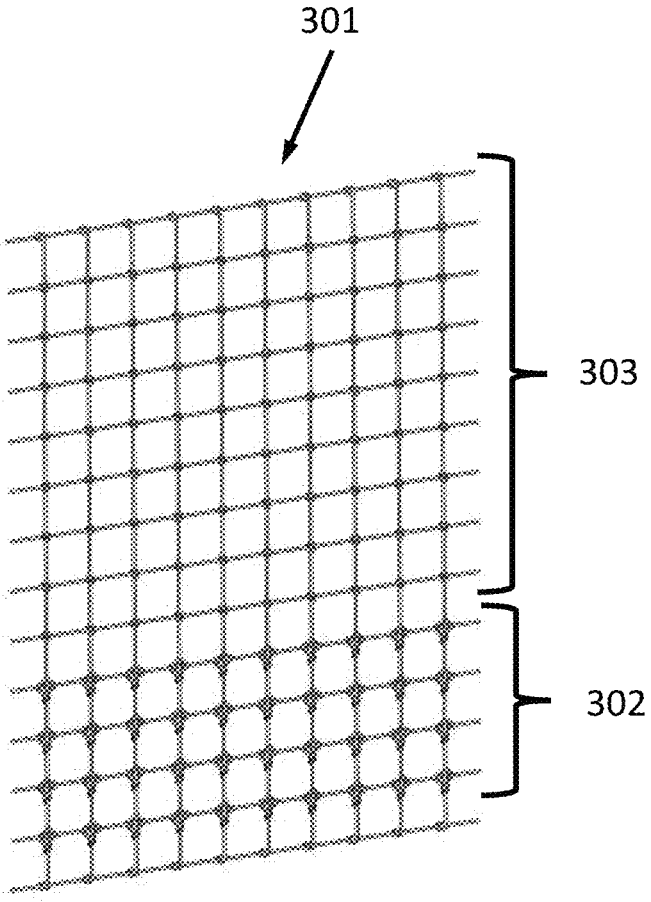
FIG. 3 is a first preferred embodiment of a fence mesh according to the present invention.

FIG. 3 shows a first preferred embodiment, being a first fence mesh 301 according to the present invention. First fence mesh 301 includes a first primary zone 302 and a first secondary zone 303.

In first primary zone 302, the stay wires and line wires are connected by fixed knots. In first secondary zone 303 the stay wires and line wires are connected by stay knots.

In one application, first fence mesh 301 may be suitable for use in confining burrowing animals. First primary zone 302 may be bent and buried in the ground, with first secondary zone 303 extending above the ground. This represents an improvement over the use of either a standard stay-knot fence or a standard fixed-knot fence, because first primary zone 302 is more resistant to distortion than a standard stay-knot mesh fence, but above ground in first secondary zone 303 the use of stay knots protects the coats or hides of the animals from damage.

Figure 4:
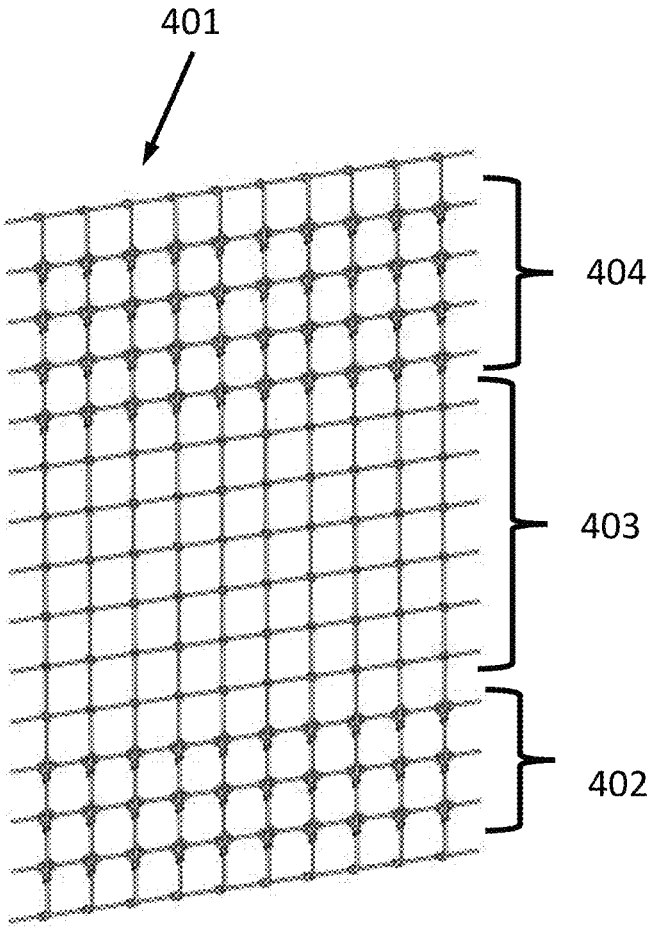
FIG. 4 is a second preferred embodiment of a fence mesh according to the present invention.

FIG. 4 shows a second preferred embodiment, being a second fence mesh 401 according to the present invention. Second fence mesh 401 includes a second primary zone 402, second secondary zone 403, and second tertiary zone 404.

In second primary zone 402, the stay wires and line wires are connected by fixed knots. In second secondary zone 403 the stay wires and line wires are connected by stay knots. In second tertiary zone 404, the stay wires and line wires are connected by fixed knots.

Second fence mesh 401 may be suitable for applications such as containing deer. At the bottom of the fence, fixed knots hold together second primary zone 402. Because the fixed knots are more rigid, this limits the ability of the animal to distort the fence and push its head through in an effort to graze on the other side of the fence. Above second primary zone 402 in second secondary zone 403 the use of stay knots protects the valuable hides of the animals from damage. Above second secondary zone 403 in second tertiary zone 404 the use of fixed knots provide a more rigid fence at the height where deer may rub their antlers, which may distort a standard stay-knot fence.

Figure 5:
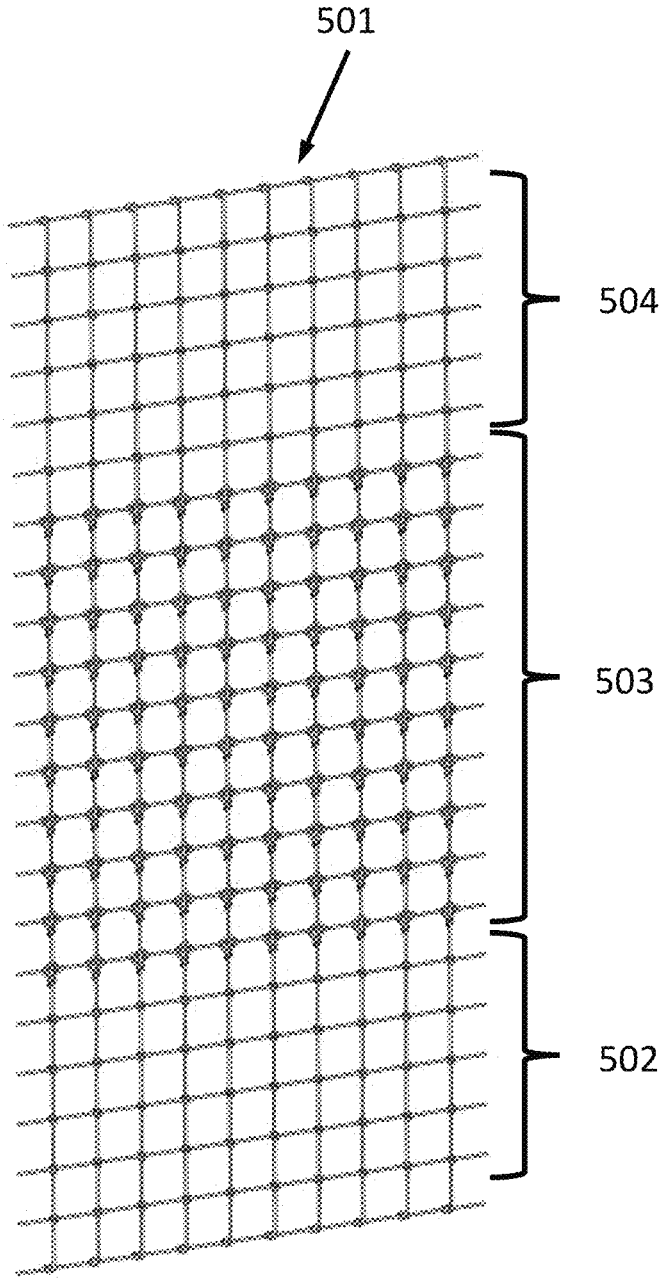
FIG. 5 is a third preferred embodiment of a fence mesh according to the present invention.

FIG. 5 shows a third preferred embodiment, being a third fence mesh 501 according to the present invention. Third fence mesh 501 includes a third primary zone 502, third secondary zone 503, and third tertiary zone 504.

In third primary zone 502, the stay wires and line wires are connected by stay knots. In third secondary zone 503 the stay wires and line wires are connected by fixed knots. In third tertiary zone 504, the stay wires and line wires are connected by stay knots.

Third fence mesh 501 may be suitable for applications such as containing heavy animals. Third fence mesh 501 is resistant to distortion in third secondary zone 503 in the middle of the height of the fence where animal heads may encounter the fence. However, in third primary zone 502 below this area, cheaper stay knots are used. Third tertiary zone 504 increases the height of the fence to contain jumping animals, but uses cheaper stay knots. This results in a fence that is strong enough to contain heavy animals, but cheaper than a conventional fixed knot fence.

It will be apparent to one skilled in the art that different numbers of line wires in each zone will increase or decrease the height of each zone, and that different zone sizes or configurations will be suitable for different applications. For example, the height of the animals to be contained in relevant to the optimal positioning of each zone. The present invention provides for the customisation of a fence mesh for specific applications, in addition to the three examples described in detail above.

It has not previously been possible to create a single fence incorporating different zones of fixed knot and stay knot on a single machine because of the different mechanisms for creating the different types of knots.

Figure 6A:
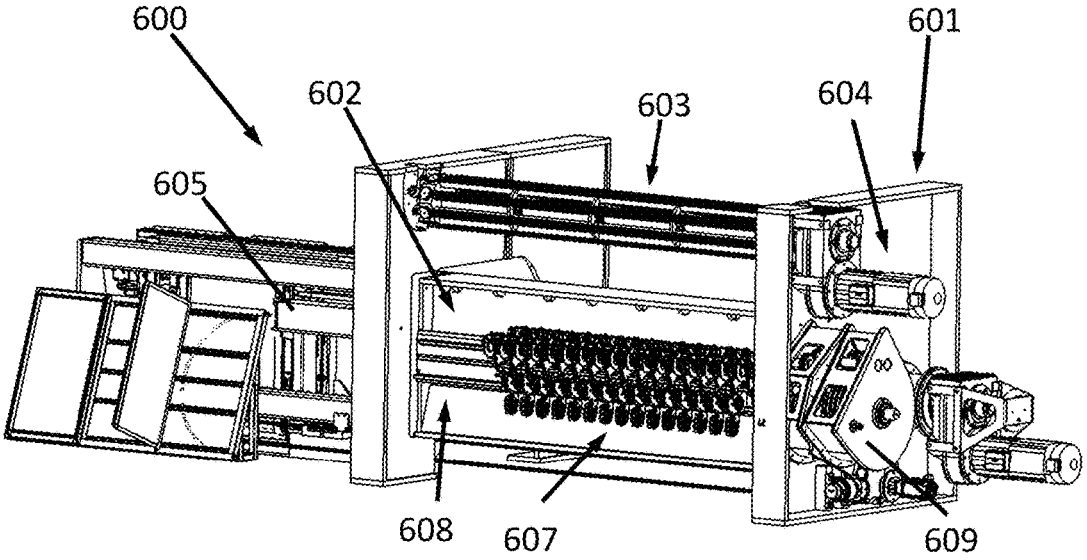
FIG. 6*a* is a back view of a machine according to the present invention.
Figure 6B:
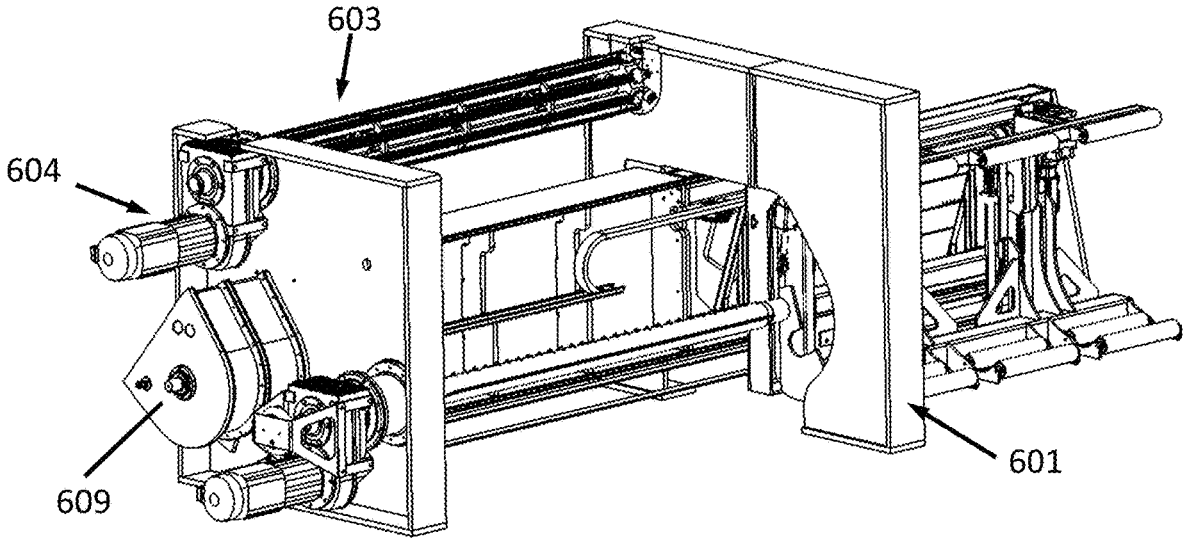
FIG. 6*b* is a front view of the machine of FIG. 6*a;*

FIGS. 6*a* and 6*b* show a machine 600 according to the present invention, including a machine frame 601 supporting a knotting bed 602, a crimp drum 603 driven by a crimp drum drive 604, a stay wire projector 605, and a series of knot boxes 607 mounted on knot drive shafts 608 driven by a knot drive 609.

A series of parallel line wires (not shown) extends substantially vertically across the knotting bed 602 from a lower edge of the knotting bed 602 to engage with crimp drum 603. A stay wire (not shown) is projected by stay wire projector 605 in known manner substantially horizontally across the knotting bed 602, with the line wires located between the stay wire and the knotting bed 602. A knot box 607 is located over each line wire, with a knot wire (not shown) fed into each knot box 607.

In known manner, over the two outer-most line wires, instead of a knot box, a standard end twister box (not shown) is provided, to twist the ends around the outer-most line wire.

Although it is known to include a single cutter adjacent the end twister box closest to the stay wire projector 605 to cut the stay wire, in an optional embodiment the machine 600 of the present invention may include a cutter adjacent each of the two end twister boxes, to cut the stay wire to a precise desired length.

Crimp drum 603 is driven by crimp drum drive 604, which in this preferred embodiment is a rotary servo motor. It operates in a step function to rotate crimp drum 603 extending the line wires across the knotting bed 602, halt while the knot boxes 607 are in operation to knot the stay wire to the line wires, then rotate a set distance to extend the line wires to be in position to receive the next stay wire for the desired spacing of stay wires in the finished fence.

Stay Knot—Knot Box

Figure 7:
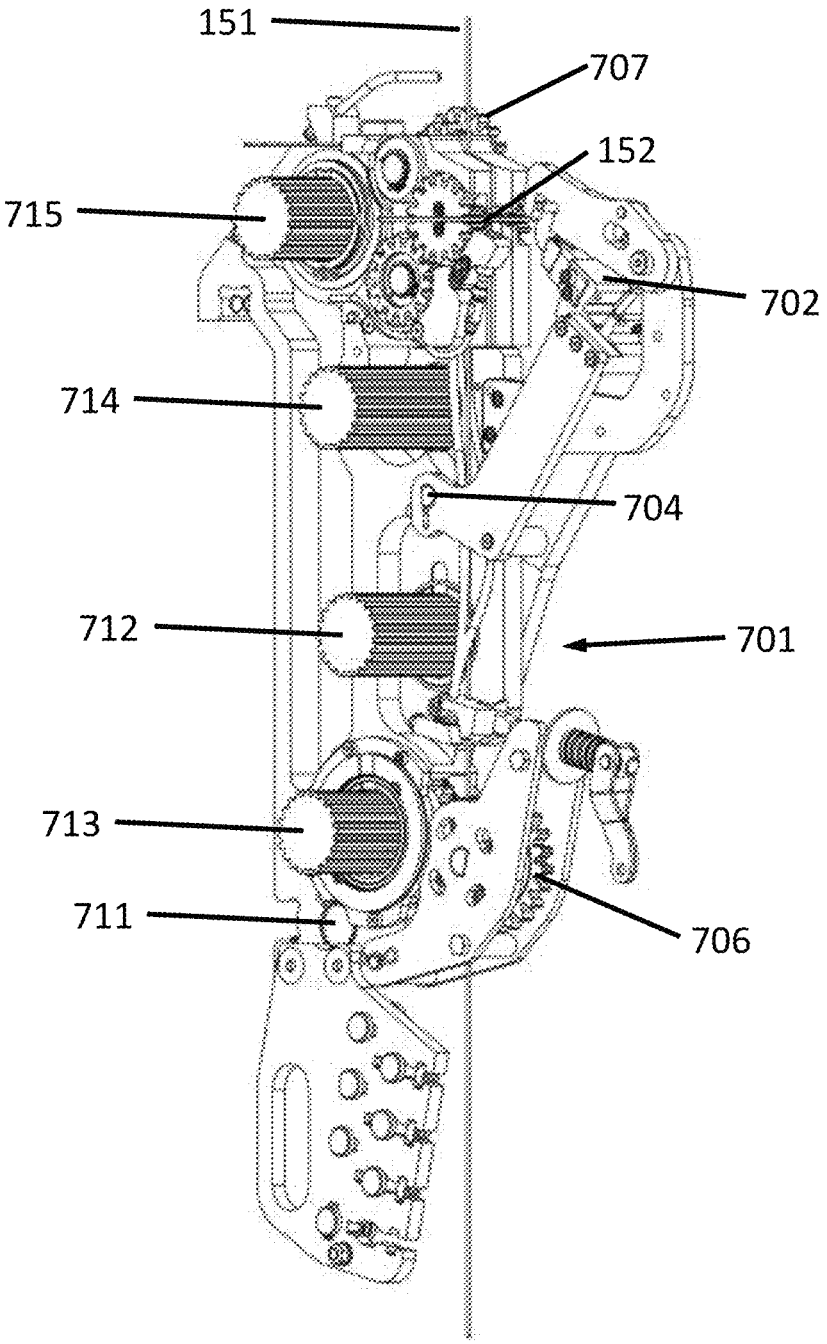
FIG. 7 is a perspective view of a stay knot box for use in the machine of the present invention.
Figure 8:
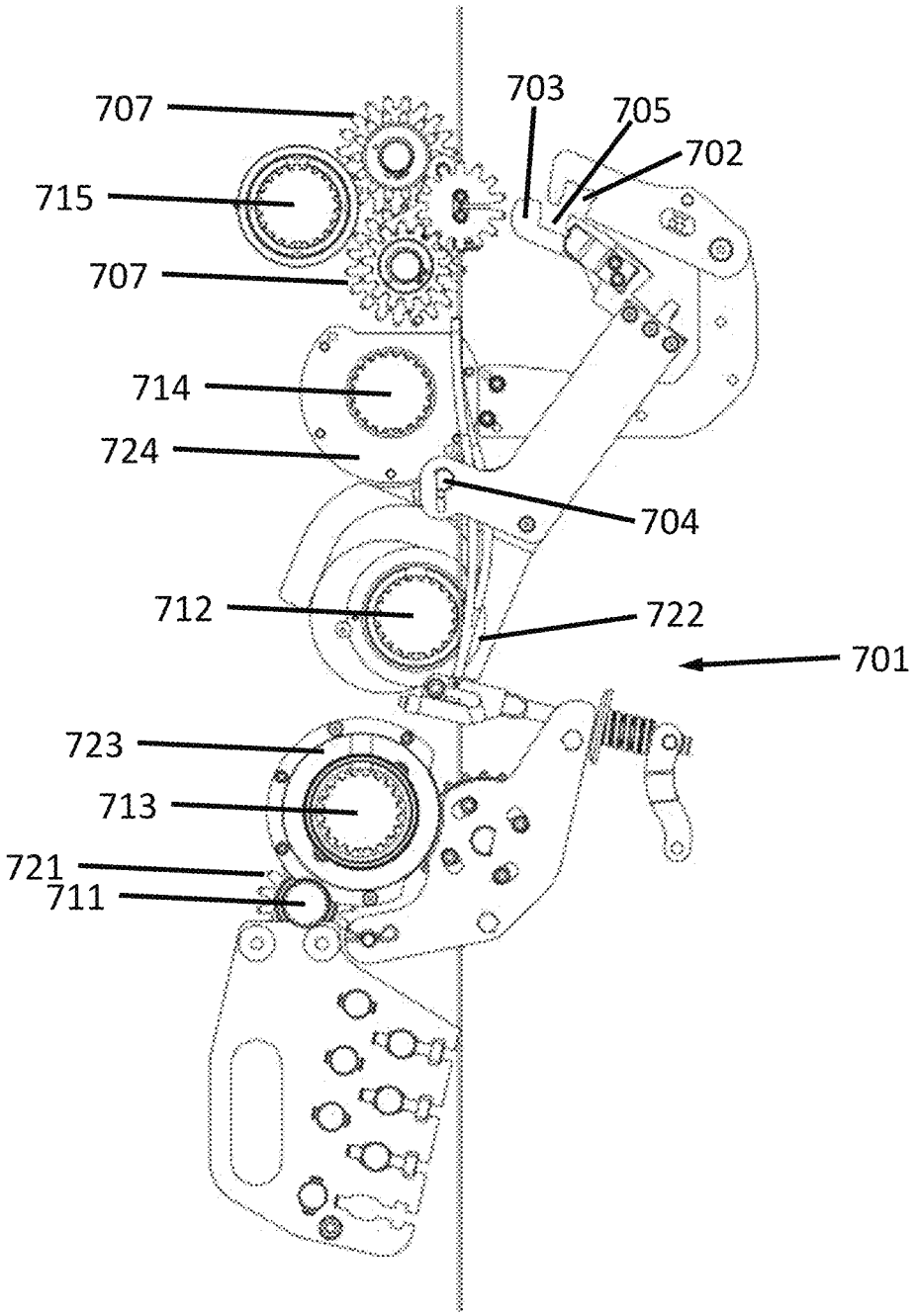
FIG. 8 is a cut-away side view of the stay knot box of FIG. 7.
Figure 9:
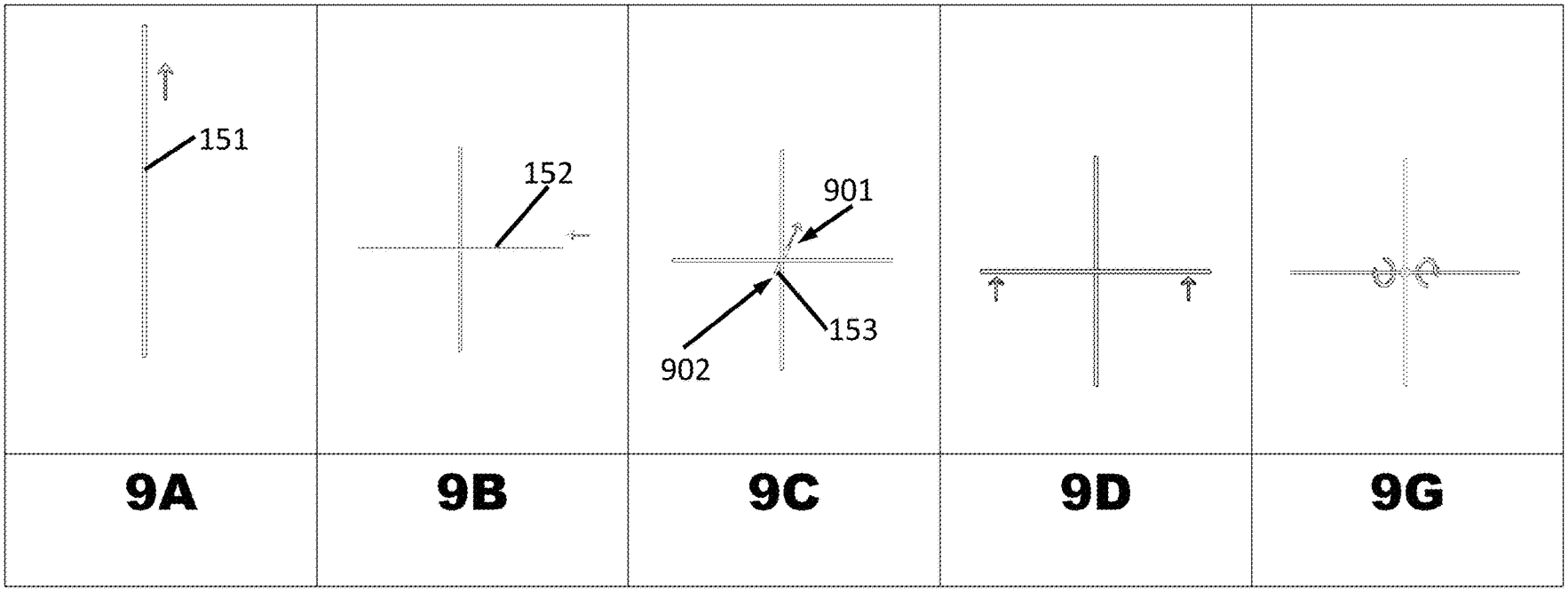
FIG. 9 is a sequence showing the wires during operation of the stay knot box of FIG. 7.

FIG. 7 shows a perspective view of a stay knot box 701 engaged with a line wire 151 and a stay wire 152, and receiving a knot wire 153. FIG. 8 shows a partial cross-section of operational parts of stay knot box 701. FIG. 9 shows the interaction of the wires in stay knot box 701 at each active step.

Stay knot box 701 receives input from the rotation of five rotary drive shafts. The rotation of the drive shafts is described relative to the placement of the drive means on one side of the machine. It will be obvious to one skilled in the art that if the drive means are placed on the other side of the machine, all the rotations will be reversed.

At step A, line wire 151 fed through the stay knot box 701 by the drive of crimp drum 603.

At step B, stay wire 152 is projected by stay wire projector 605 across line wire 151 through a stay wire support guide 702.

At step C, first drive shaft 711 rotates in a clockwise direction. First drive shaft 711 is engaged with a first drive shaft receiver 721 in the stay knot box 701. First drive shaft receiver 721 includes gear teeth that engage with a knot wire gear 706 so that rotation of first drive shaft receiver 721 feeds the knot wire 153 into position behind line wire 151 at an angle thereto. First drive shaft 721 stops rotating.

At step D, second drive shaft 712 rotates in an anti-clockwise direction. Second drive shaft 712 is engaged with a second drive shaft receiver 722 in the stay knot box 701. Second drive shaft receiver 722 is asymmetrical, so that initial rotation of second drive shaft receiver 722 rotates placer arm 703 about placer arm pivot 704 to the position shown in FIG. 8, so stay wire 152 engages with stay wire placer groove 705. The continuing rotation of asymmetrical second drive shaft receiver 722 then rotates placer arm 703 back to the position shown in FIG. 7, in which the stay wire 152 is now adjacent line wire 151. The second drive shaft 722 also activates a cutting to blade (not part of knot box 701, and therefore not shown) to cut stay wire 152. Second drive shaft 712 stops rotating.

At step E, third drive shaft 713 rotates in an anti-clockwise direction. Third drive shaft receiver 723 in the stay knot box 701 is adapted to allow third drive shaft 713 to rotate freely within it, without activating any mechanism in stay knot box 701.

At step F, fourth drive shaft 714 rotates in an anti-clockwise direction. Fourth drive shaft receiver 724 in the stay knot box 701 is adapted to allow fourth drive shaft 714 to rotate freely within it, without activating any mechanism in stay knot box 701.

At step G, fifth drive shaft 715 rotates in a clockwise direction. Fifth drive shaft 715 is engaged with a fifth drive shaft receiver 725 in the stay knot box 701. Rotation of fifth drive shaft receiver 725 simultaneously drives two sets of twisting gears 707, each of which may also incorporate cams (not shown) to elongate the action so as to reduce tension on the knot wire 153 during this step G. Twisting gears on a first side of line wire 151 cut knot wire 153 to create a first end 901 of the knot wire 153, and twist first end 901 clockwise about adjacent stay wire 152 on the first side of line wire 151. Twisting gears on a second side of line wire 151 twist a second end 902 of knot wire 153 anti-clockwise about adjacent stay wire 152 on the second side of line wire 151. Fifth drive shaft 725 stops rotating.

Fixed Knot—Knot Box

Figure 10:
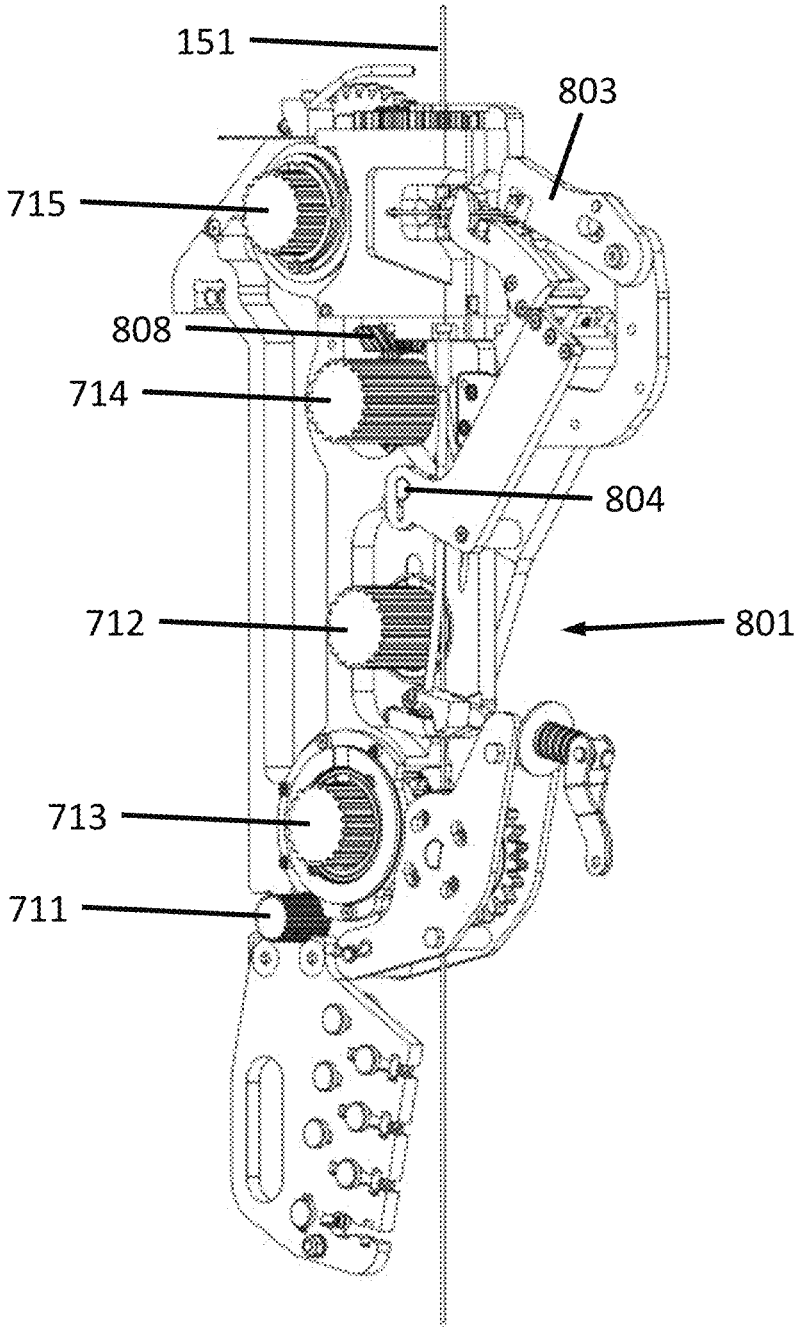
FIG. 10 is a perspective view of a fixed knot box for use in the machine of the present invention.
Figure 11:
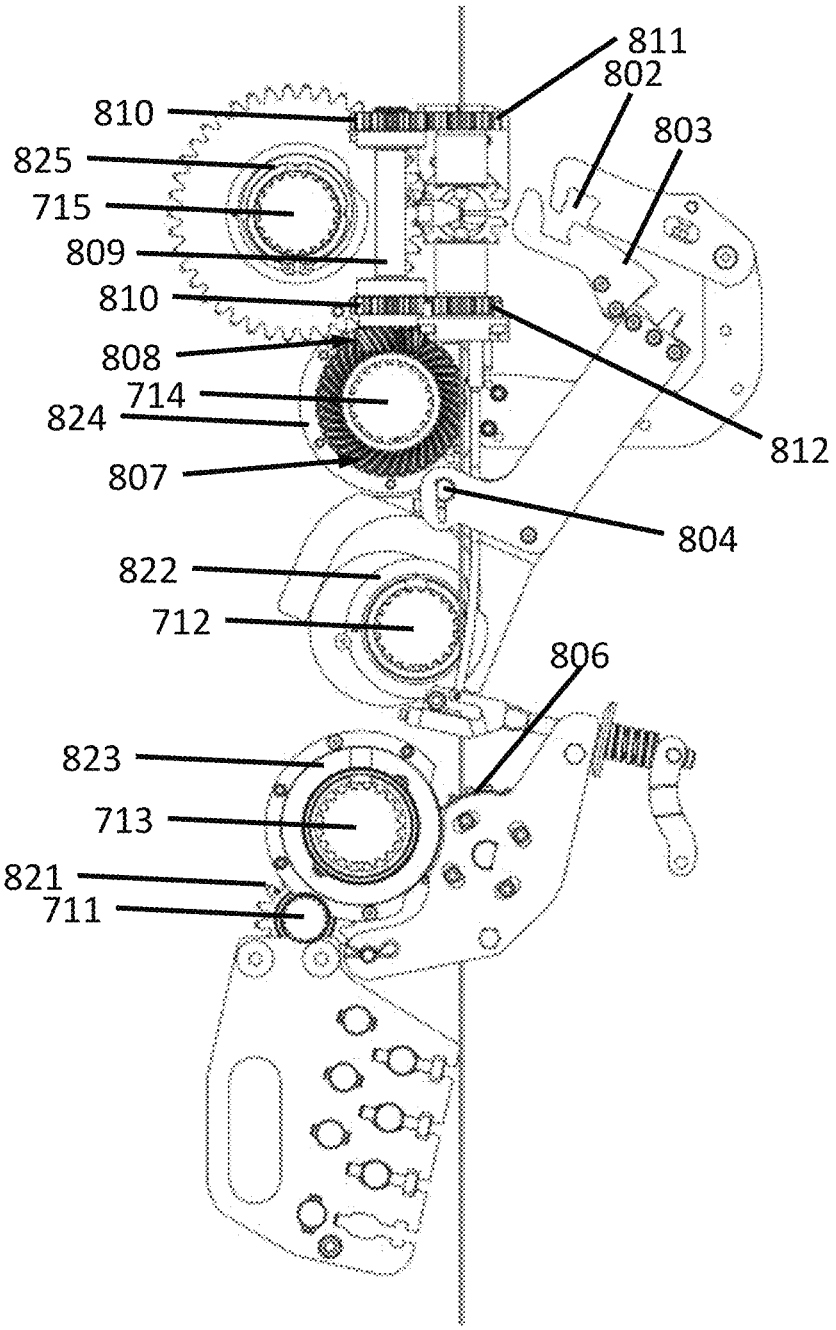
FIG. 11 is a cut-away side view of the fixed knot box of FIG. 10.
Figure 12:
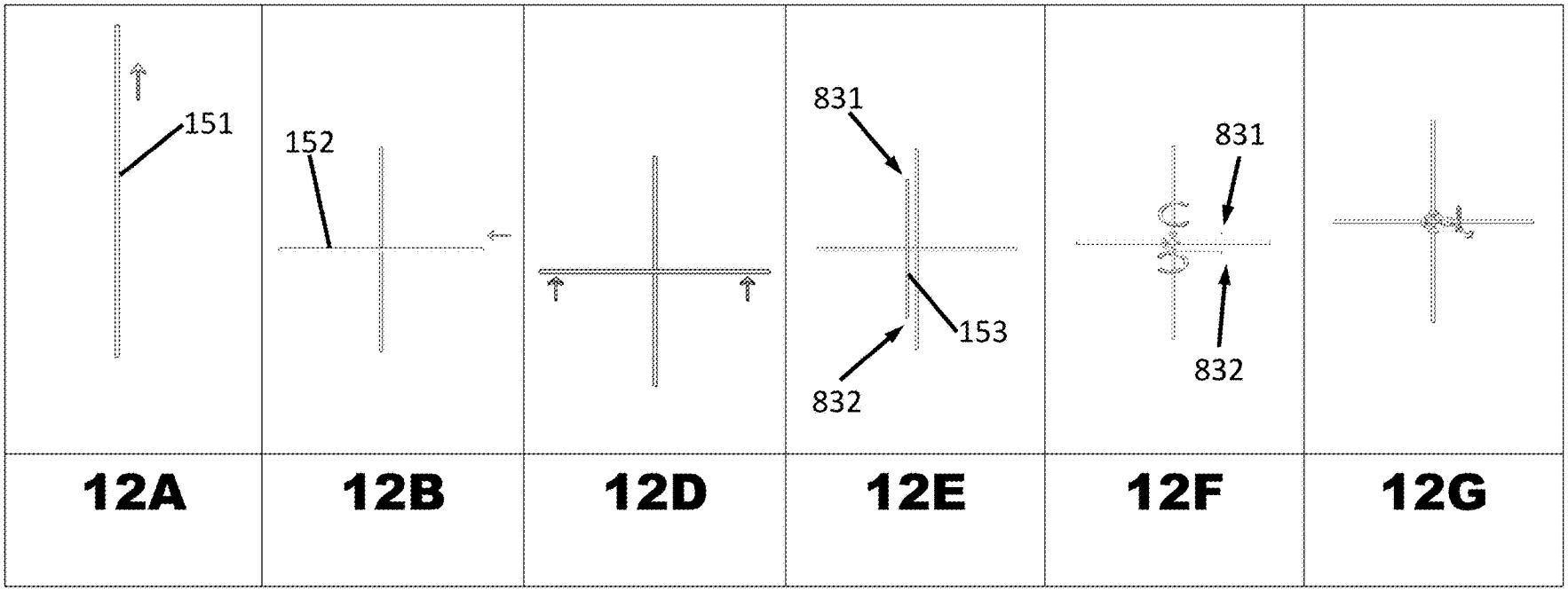
FIG. 12 is a sequence showing the wires during operation of the fixed knot box of FIG. 10.

FIG. 10 shows a perspective view of a fixed knot box 801 engaged with a line wire 151 and a stay wire 152, and receiving a knot wire 153. FIG. 11 shows a partial cross-section of operational parts of stay knot box 801. FIG. 12 shows the interaction of the wires in fixed knot box 801 at each active step.

Fixed knot box 801 receives input from the rotation of five rotary drive shafts. The rotation of the drive shafts is described relative to the placement of the drive means on one side of the machine. It will be obvious to one skilled in the art that if the drive means are placed on the other side of the machine, all the rotations will be reversed.

At step A, line wire 151 fed through the fixed knot box 801 by the drive of crimp drum 603.

At step B, stay wire 152 is projected by stay wire projector 605 across line wire 151 through a stay wire support guide 802.

At step C, first drive shaft 711 rotates in an clockwise direction. First drive shaft receiver 821 in the fixed knot box 801 is adapted to allow first drive shaft 711 to rotate freely within it, without activating any mechanism in fixed knot box 801.

At step D, second drive shaft 712 rotates in an anti-clockwise direction. Second drive shaft 712 is engaged with a second drive shaft receiver 822 in the fixed knot box 801. Second drive shaft receiver 822 is asymmetrical, so that initial rotation of second drive shaft receiver 822 rotates placer arm 803 about placer arm pivot 804, until stay wire 152 engages with a stay wire placer groove. The continuing rotation of asymmetrical second drive shaft receiver 822 then rotates placer arm 803 back to the position shown in FIG. 11, in which the stay wire 152 is now adjacent line wire 151. The second drive shaft 712 also activates a cutting blade (not part of knot box 801, and therefore not shown) to cut knot wire 153. Second drive shaft 712 stops rotating.

At step E, third drive shaft 713 rotates in an anti-clockwise direction. Third drive shaft 713 is engaged with a third drive shaft receiver 823 in the fixed knot box 801. Third drive shaft receiver 823 includes gear teeth that engage with a knot wire gear 806 so that rotation of third drive shaft receiver 823 feeds knot wire 153 into position parallel to line wire 151, on an opposite side of stay wire 152 to line wire 151. Third drive shaft 713 stops rotating.

At step F, fourth drive shaft 714 rotates in an anti-clockwise direction. Fourth drive shaft 714 is engaged with a fourth drive shaft receiver 824 in the fixed knot box 801. Fourth drive shaft receiver 824 is fitted with drive bevel gear teeth 807 to engage with shaft bevel gear teeth 808 to drive a twist shaft 809 connected to twist activation gears 810. Each twist activation gear is engaged with a set of twist gears. First twist gears 811 on a first side of stay wire 152 twist a first end 831 of knot wire 153 on the first side of stay wire 152 under line wire 151 on a side of line wire 151 opposite stay wire 152, then anti-clockwise around line wire 151 in a 360° rotation to the Jo position shown in FIG. 12F. Simultaneously, second twist gears 812 on a second side of stay wire 152 perform a mirror image action to twist a second end 832 of knot wire 153 on the second side of stay wire 152 under line wire 151 on a side of line wire 151 opposite stay wire 152, then anti-clockwise around line wire 151 in a 360° rotation to the position shown in FIG. 12F. Fourth drive shaft 714 stops rotating.

At step G, fifth drive shaft 715 rotates in a clockwise direction. Fifth drive shaft 715 is engaged with a fifth drive shaft receiver 825 in the fixed knot box 801. Fifth drive shaft receiver 825 includes gear teeth that engage with a tying gear 813 that engages with both first end 831 and second end 832 of knot wire 153 to wind both first end 831 and second end 832 of knot wire 153 around stay wire 152. Fifth drive shaft 715 stops rotating.

Machine Configured to Manufacture the Fence of the Present Invention

To produce the fence according to the first embodiment of the present invention, machine 600 is configured to include a primary zone including at least one fixed knot box 801, and a secondary zone including at least one stay knot box 701. The same five drive shafts 608 pass through all of the fixed knot boxes 801 and stay knot boxes 701. Each drive shaft therefore provides the same rotary motion to all knot boxes at the same time. The first rotary motion received by each fixed knot box 801 is the same as the first rotary motion received by each stay knot box 701. The second rotary motion received by each fixed knot box 801 is the same as the second rotary motion received by each stay knot box 701. The third rotary motion received by each fixed knot box 801 is the same as the third rotary motion received by each stay knot box 701. The fourth rotary motion received by each fixed knot box 801 is the same as the fourth rotary motion received by each stay knot box 701. The fifth rotary motion received by each fixed knot box 801 is the same as the fifth rotary motion received by each stay knot box 701.

To produce the fence according to the second embodiment of the present invention, machine 600 is configured to include a primary zone including at least one fixed knot box 801, a secondary zone including at least one stay knot box 701, and a tertiary zone including at least one fixed knot box 801. The same five drive shafts 608 pass through all of the fixed knot boxes 801 and stay knot boxes 701. Each drive shaft therefore provides the same rotary motion to all knot boxes at the same time. The first rotary motion received by each fixed knot box 801 is the same as the first Jo rotary motion received by each stay knot box 701. The second rotary motion received by each fixed knot box 801 is the same as the second rotary motion received by each stay knot box 701. The third rotary motion received by each fixed knot box 801 is the same as the third rotary motion received by each stay knot box 701. The fourth rotary motion received by each fixed knot box 801 is the same as the fourth rotary motion received by each stay knot box 701. The fifth rotary motion received by each fixed knot box 801 is the same as the fifth rotary motion received by each stay knot box 701.

To produce the fence according to the third embodiment of the present invention, machine 600 is configured to include a primary zone including at least one stay knot box 701, a secondary zone including at least one fixed knot box 801, and a tertiary zone including at least one stay knot box 701. The same five drive shafts 608 pass through all of the fixed knot boxes 801 and stay knot boxes 701. Each drive shaft therefore provides the same rotary motion to all knot boxes at the same time. The first rotary motion received by each fixed knot box 801 is the same as the first rotary motion received by each stay knot box 701. The second rotary motion received by each fixed knot box 801 is the same as the second rotary motion received by each stay knot box 701. The third rotary motion received by each fixed knot box 801 is the same as the third rotary motion received by each stay knot box 701. The fourth rotary motion received by each fixed knot box 801 is the same as the fourth rotary motion received by each stay knot box 701. The fifth rotary motion received by each fixed knot box 801 is the same as the fifth rotary motion received by each stay knot box 701.

It will be obvious to one skilled in the art that the machine 601 may be configured to produce a range of fences having different desired characteristics, by including differing numbers of zones including different numbers of fixed knot boxes 801 and stay knot boxes 701. Because all the knot boxes are driven by the same rotary motion of the same drive shafts, the same machine can be reconfigured by swapping the knot boxes in different zones to produce different types of fence according to the present invention.

Control of Drive Shaft Activation

Knot drive shafts 608 may be driven by rotational servo motors installed on machine frame 601. It will be appreciated by one skilled in the art that these servo motors can be controlled by a single controller, which can also be used to control crimp drum drive 604 and/or stay wire unit 605 to provide complete control for the machine 600. In alternative embodiments, there may be multiple controllers, each of which may control one or more servo motors and/or the crimp drum drive 604 and/or stay wire unit 605.

The controller can be programmed to drive the drive shafts 608 to provide the same five rotary motions to each of the stay knot boxes and fixed knot boxes described above in detail.

An alternative embodiment uses a rotary gear box to deliver the timed rotation of the five drive shafts. This may have advantages in some situations over the operation of electronic drive controllers, which may require specialist training, and be more expensive to purchase and maintain.

It will be apparent to one skilled in the art that at least one mechanical motion control system such as rotary gear box can be used to operate any number of components of the machine, and that one or more mechanical or electronically controlled systems, or any combination thereof, can be used. For example, instead of a separate crimp drum drive, a rotary gear box can include a crimp drum drive gear, driven in the same timed manner as the rotational drivers.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

This invention may also be said broadly to consist in the parts, elements and features referred to or indicated in the specification of the application, individually or collectively, and any or all combinations of any two or more of said parts, elements and features, and where specific integers are mentioned herein which have known equivalents in the art to which this invention relates, such known equivalents are deemed to be incorporated herein as if individually set forth.

We claim:

1. A machine for making a fence mesh including line wires, and stay wires extending laterally across and intersecting the line wires to form a mesh, wherein a wire knot is formed by a knot wire around the line wire and stay wire at intersections of the stay wires with the line wires, the machine including a machine frame, at least four drive shafts, and a drive shaft driving means, wherein the machine also includes both at least one first knot box configured to produce a first type of wire knot in a primary zone and at least one second knot box configured to produce a second type of wire knot in a secondary zone, wherein the first type of wire knot is different from the second type of wire knot.

2. The machine according to claim 1, wherein one of the first type of wire knot and the second type of wire knot is a fixed knot.

3. The machine according to claim 1, wherein one of the first type of wire knot and the second type of wire knot is a stay knot.

4. The machine according to claim 1, wherein the machine includes more than two zones.

5. The machine according to claim 1, wherein the machine includes five drive shafts.

* * * * *